106-97 AU 118 EX
8/28/84 OR 4,468,253

United States Patent [19]
Tajima et al.

[11] Patent Number: 4,468,253
[45] Date of Patent: Aug. 28, 1984

[54] METHOD AND APPARATUS FOR CONTINUOUSLY MANUFACTURING NON-SINTERED PELLET

[75] Inventors: Osamu Tajima, Kamakura; Seiji Matsui, Kawasaki; Hideyuki Yoshikoshi, Hino; Tsuneo Miyashita, Yokohama; Michio Nakayama, Kawasaki, all of Japan

[73] Assignee: Nippon Kokan Kabushiki Kaisha, Tokyo, Japan

[21] Appl. No.: 458,751

[22] Filed: Jan. 17, 1983

[30] Foreign Application Priority Data

Feb. 2, 1982 [JP] Japan ..... 57-14315

[51] Int. Cl.[3] ..... C04B 7/35
[52] U.S. Cl. ..... 106/97; 106/117; 75/3
[58] Field of Search ..... 106/89, 97, 104, 117; 75/3

[56] References Cited

U.S. PATENT DOCUMENTS 3,925,069 12/1975 Shimada et al. ..... 106/89
4,049,435 9/1977 Lotosh et al. ..... 75/3
4,388,116 6/1983 Carrillo-Cantu et al. ..... 106/89

FOREIGN PATENT DOCUMENTS 0003665 8/1979 European Pat. Off. ..... 75/3

*Primary Examiner*—James Poer
*Attorney, Agent, or Firm*—Frishauf, Holtz, Goodman & Woodward

[57] ABSTRACT

A method and an apparatus for continuously manufacturing a non-sintered pellet, which comprises:

continuously supplying a green pellet having a water content of from 6 to 20 wt. % into a shaft type reactor to continuously pass the green pellet sequentially through a pre-treating zone, a hydration reaction zone and a drying zone in the shaft type reactor; blowing a pre-treating gas with a relative humidity of up to 70% and at a temperature of from 65° to 250° C. into the pre-treating zone to pre-dry the green pellet in the pre-treating zone until the difference in the water content in the green pellet before and after the abovementioned pre-drying becomes at least 4 wt. % within the limits in which the green pellet in the pre-treating zone contains at least 2 wt. % water; blowing a gas for hydration reaction at a temperature of from 50° to 100° C. containing saturated steam into the hydration reaction zone to hydrate the green pellet in the zone; and, blowing a drying gas at a temperature of from 100° to 300° C. into the drying zone to dry the green pellet in the zone, thereby hardening the green pellet in the drying zone to continuously manufacture a non-sintered pellet.

4 Claims, 2 Drawing Figures

METHOD AND APPARATUS FOR CONTINUOUSLY MANUFACTURING NON-SINTERED PELLET

FIELD OF THE INVENTION

The present invention relates to a method and an apparatus for continuously manufacturing a non-sintered pellet or a non-sintered briguette (hereinafter generically called a "non-sintered pellet"), which comprise adding a hydraulic binder and water to raw materials which comprise at least one of an iron ore fine, a non-ferrous ore fine and a dust mainly containing oxides of iron or non-ferrous metal, and mixing same; forming the resultant mixture into a green pellet or a green briquette (hereinafter generically called a "green pellet"); and hardening without sintering the green pellet thus formed into a non-sintered pellet.

BACKGROUND OF THE INVENTION

The following methods for manufacturing a non-sintered pellet are known:

(1) Gränges method:

A method which comprises supplying a green pellet, together with an iron ore fine, into a first vessel, holding same in the first vessel for a period of about one and a half days to hydrate same, then, supplying said green pellet into a second vessel, holding same in the second vessel for a period of about five days to hydrate same, and then, holding said green pellet in an outdoor yard for about 20 days to allow same to be hydrated, thereby hardening said green pellet to manufacture a non-sintered pellet.

(2) COBO method:

A method which comprises supplying a green pellet into a vessel, and blowing steam under a high pressure at a temperature of about 200° C. into said vessel to hydrate said green pellet in said vessel, thereby hardening said green pellet to manufacture a non-sintered pellet.

(3) Nippon Steel method:

A method which comprises holding a green pellet in an indoor yard for about three days to hydrate same, and then holding said green pellet in an outdoor yard for about five days to hydrate same, thereby hardening said green pellet to manufacture a non-sintered pellet.

However, the methods (1) and (3) above have the problem that these methods require a long period of time for hydrating the green pellet, and the method (2) above involves the safety and economic problem because of requiring high-temperature and high-pressure steam for hydrating the green pellet.

European Patent Provisional Publication No. 0003665 dated Aug. 22, 1979 discloses a method for continuously manufacturing a non-sintered pellet which enables to solve the above-mentioned problems and to hydrate a green pellet in a relatively short period of time without needing high-temperature and high-pressure steam (hereinafter referred to as the "prior art").

More specifically, the prior art discloses a method for continuously manufacturing a non-sintered pellet which comprises continuously supplying a green pellet into a shaft type reactor comprising a pre-treating zone, a hydration reaction zone following said pre-treating zone and a drying zone following said hydration reaction zone, to continuously pass said green pellet sequentially through said pre-treating zone, said hydration reaction zone and said drying zone; blowing a pre-treating gas with a relative humidity of from 80 to 100% and at a temperature of up to 60° C. into said pre-treating zone to pre-treat said green pellet in said zone; blowing a gas for hydration reaction at a temperature of from 90° to 100° C. containing saturated steam into said hydration reaction zone to hydrate said green pellet in said zone; and, blowing a drying gas at a temperature of from 100° to 500° C. into said drying zone to dry said green pellet in said zone, thereby hardening said green pellet in said drying zone to continuously manufacture a non-sintered pellet.

However, the prior art is has the problem that, when hydrating the green pellet in the hydration reaction zone, part of the green pellet disintegrates in the hydration reaction zone. When part of the green pellet disintegrates in the hydration reaction zone, not only is the product yield lowered, but also the resultant disintegration products cause mutual adherence of other sound pieces of green pellet in the shaft type reactor into clusters. Adherence of these clusters onto the inner surface of the side wall of the shaft type reactor causes scaffolding in the shaft type reactor, preventing smooth transfer of the green pellet through the shaft type reactor, and finally makes it impossible to manufacture a non-sintered pellet.

With these problems in view, there is an increasing demand for developing a method and an apparatus for continuously manufacturing a high-strength and high-quality non-sintered pellet at a high yield, which do not cause disintegration of a green pellet in a shaft type reactor when continuously manufacturing a non-sintered pellet by continuously supplying the green pellet into the shaft type reactor comprising a pre-treating zone, a hydration reaction zone following said pre-treating zone and a drying zone following said hydration reaction zone to pass said green pellet sequentially through said pre-treating zone, said hydration reaction zone and said drying zone, and in the meantime hardening said green pellet. However, such a method and an apparatus have not as yet been proposed.

SUMMARY OF THE INVENTION

An object of the present invention is therefore to provide a method and an apparatus for manufacturing a non-sintered pellet, which permit, when manufacturing a non-sintered pellet by continuously supplying a green pellet into a shaft type reactor and hardening without sintering the green pellet in the shaft type reactor, continuous manufacture of a high-strength and high-quality non-sintered pellet at a high yield without causing disintegration of the green pellet in the shaft type reactor.

In accordance with one of the features of the present invention, there is provided a method for continuously manufacturing a non-sintered pellet, which comprises:

adding a hydraulic binder and water to raw materials which comprise at least one of an iron ore fine, a non-ferrous ore fine and a dust mainly containing oxides of iron or non-ferrous metal, and mixing same; forming the resultant mixture to prepare a green pellet having a water content within the range of from 6 to 20 wt. %; continuously supplying said green pellet into a shaft type reactor which comprises a pre-treating zone, a hydration reaction zone following said pre-treating zone and a drying zone following said hydration reaction zone, to continuously pass said green pellet sequentially through said pre-treating zone, said hydration reaction zone and said drying zone; blowing a pre-treating gas at a prescribed temperature into said pre-treating zone to pre-treat said green pellet in said zone; blowing a gas for hydration reaction at a temperature within the range of from 50° to 100° C. containing a saturated steam into said hydration reaction zone to hydrate said green pellet in said zone; and, blowing a drying gas at a temperature within the range of from 100° to 300° C. into said drying zone to dry said green pellet in said zone, thereby hardening said green pellet in said drying zone to continuously manufacturing a non-sintered pellet;

characterized by:

blowing said pre-treating gas with a relative humidity of up to 70% and at a temperature within the range of from 65° to 250° C. into said pre-treating zone to pre-dry said green pellet in said pre-treating zone until the difference in the water content in said green pellet before and after said pre-drying becomes at least 4 wt. % within the limits in which said green pellet in said pre-treating zone contains at least 2 wt. % water.

DETAILED DESCRIPTION OF PREFERRED EMBODIMENTS

Figure 1:
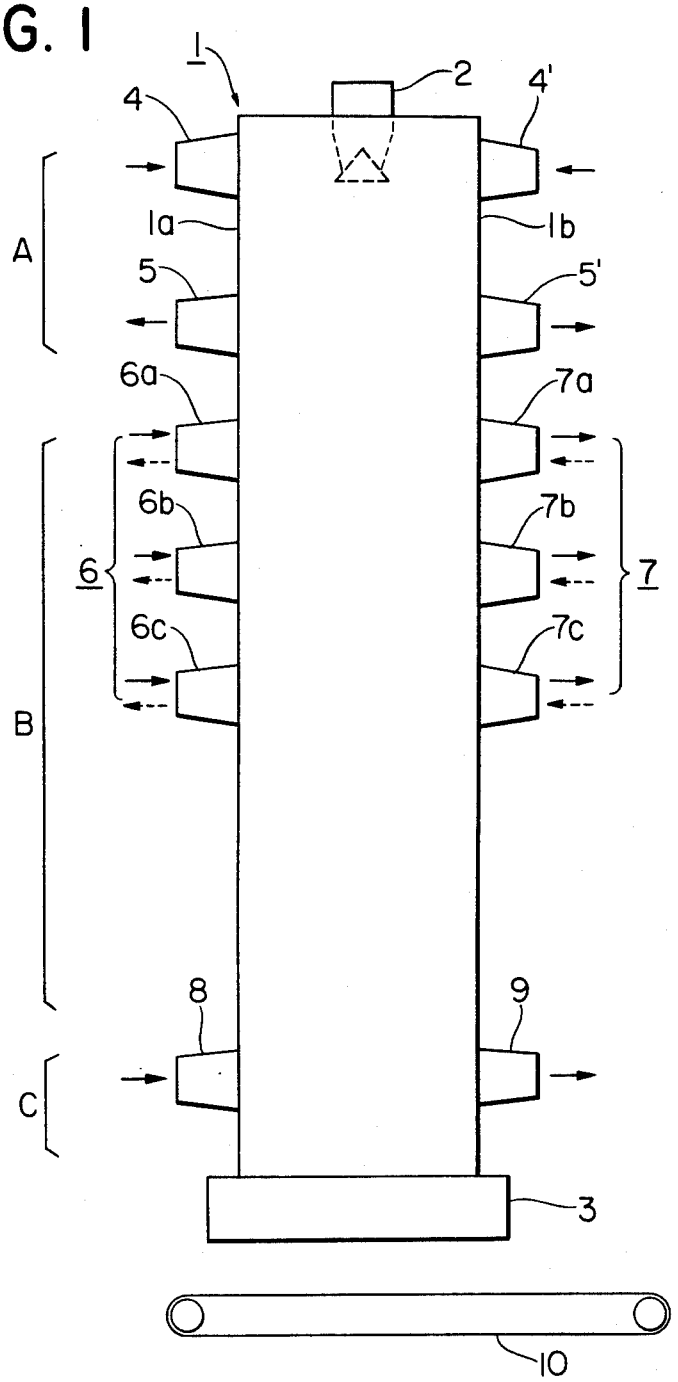
FIG. 1 is a schematic drawing illustrating an embodiment of the apparatus used in the method of the present invention; and, FIG. 2 is a schematic drawing illustrating another embodiment of the apparatus used in the method of the present invention.

From the above-mentioned point of view, we have carried out extensive studies with a view to developing a method and an apparatus for manufacturing a non-sintered pellet, which permit, when manufacturing a non-sintered pellet by continuously supplying a green pellet into a shaft type reactor and hardening without sintering the green pellet in the shaft type reactor, continuous manufacture of a high-strength and high-quality non-sintered pellet at a high yield without causing disintegration of the green pellet in the shaft type reactor.

We first searched for the cause of disintegration of the green pellet in the prior art discribed above, and obtained the following finding. As mentioned above, the prior art comprises continuously supplying a green pellet into a shaft type reactor which comprises a pre-treating zone, a hydration reaction zone following said pre-treating zone, and a drying zone following said hydration reaction zone to continuously pass said green pellet sequentially through said pre-treating zone, said hydration reaction zone and said drying zone; pre-treating said green pellet in said pre-treating zone, hydrating said green pellet in said hydration reaction zone, and, drying said green pellet in said drying zone. The above-mentioned pre-treatment of the green pellet in the pre-treating zone has an object to preliminarily hydrate the green pellet in the pre-treating zone by means of a pre-treating gas with a relative humidity of from 80 to 100% and at a temperature of up to 60° C. which is blown into the pre-treating zone. However, since a green pellet generally contains water of from 6 to 20 wt. %, the water content in the green pellet becomes excessive to cause the surface thereof to become soft and sticky through the preliminary hydration in the pre-treating zone and the hydration in the hydration reaction zone. Furthermore, during hydration of the green pellet with a high-temperature gas in the hydration reaction zone, the water contained in the green pellet suddenly vaporizes to cause steam explosion, leading to disintegration of the green pellet.

In view of the above-mentioned cause of disintegration of the green pellet in the prior art, we found that it is possible to prevent the green pellet from disintegrating by drying the green pellet in the pre-treating zone by means of a pre-treating gas with a relative humidity of up to 70% and at a temperature within the range of from 65° to 250° C.

The present invention was made on the basis of the above-mentioned finding, and the method for manufacturing a non-sintered pellet of the present invention comprises:

adding a hydraulic binder and water to raw materials which comprise at least one of an iron ore fine, a non-ferrous ore fine, and a dust mainly containing oxides of iron or non-ferrous metal, and mixing same; forming the resultant mixture to prepare a green pellet having a water content within the range of from 6 to 20 wt. %; continuously supplying said green pellet into a shaft type reactor which comprises a pre-treating zone, a hydration reaction zone following said pre-treating zone and a drying zone following said hydration reaction zone, to continuously pass said green pellet sequentially through said pre-treating zone, said hydration reaction zone and said drying zone; blowing a pre-treating gas at a prescribed temperature into said pre-treating zone to pre-treat said green pellet in said zone; blowing a gas for hydration reaction at a temperature within the range of from 50° to 100° C. containing saturated steam into said hydration reaction zone to hydrate said green pellet in said zone; and, blowing a drying gas at a temperature within the range of from 100° to 300° C. into said drying zone to dry said green pellet in said zone, thereby hardening said green pellet in said drying zone to continuously manufacturing a non-sintered pellet:

characterized by:

blowing said pre-treating gas with a relative humidity of up to 70% and at a temperature within the range of from 65° to 250° C. into said pre-treating zone to pre-dry said green pellet in said pre-treating zone until the difference in the water content in said green pellet before and after said pre-drying becomes at least 4 wt. % within the limits in which said green pellet in said pre-treating zone contains at least 2 wt. % water.

Pre-drying the green pellet in the pre-treating zone by means of a pre-treating gas with a relative humidity of up to 70% and at a temperature within the range of from 65° to 250° C. which is blown into the pre-treating zone has an object to prevent, during hydration in the hydration reaction zone, the green pellet which contains water of from 6 to 20 wt. % from containing excessive water which leads to a soft and sticky surface, and to prevent, during hydration of the green pellet in the hydration reaction zone by means of a high-temperature gas, the water contained in the green pellet from suddenly vaporizing to cause steam explosion.

The pre-treating gas should have a relative humidity of up to 70% and a temperature within the range of from 65° to 250° C. If the relative humidity of the pre-treating gas is over 70%, it becomes difficult to pre-dry the green pellet in the pre-treating zone to a prescribed value described later in a short period of time. If the temperature of the pre-treating gas is under 65° C., it is difficult to pre-dry the green pellet in the pre-treating zone to a prescribed value in a short period of time. When, on the other hand, the temperature of the pre-treating gas is over 250° C., the green pellet in the pre-treating zone suffers from thermal shock caused by the pre-treating gas, and this may lead to disintegration of the green pellet.

Pre-drying of the green pellet in the pre-treating zone should be carried out until the difference in the water content in the green pellet before and after the pre-drying reaches at least 4 wt. % within the limits in which the green pellet in the pre-treating zone contains at least 2 wt. % water. If the water content in the green pellet after pre-drying is under 2 wt. %, it becomes difficult to hydrate the green pellet in the hydration reaction zone, and as a result, it is impossible to manufacture a high-quality non-sintered pellet. When the difference in the water content in the green pellet before and after the pre-drying is under 4 wt. %, it is impossible, during hydration of the green pellet in the hydration reaction zone by means of a high-temperature gas, to prevent the occurrence of steam explosion caused by the sudden vaporization of the water contained in the green pellet.

As the hydration reaction gas for hydrating the green pellet in the hydration reaction zone, a gas containing saturated steam is used because, when the temperature of the hydration reaction gas containing saturated steam lowers through heat exchange with the green pellet in the hydration reaction zone, at least part of steam contained in the hydration reaction gas condenses to generate condensation heat which makes up for the heat of the hydration reaction gas lost through the heat exchange with the green pellet, thus allowing efficient heating of the green pellet. The temperature of the hydration reaction gas should be within the range of from 50° to 100° C. If the temperature of the hydration reaction gas is under 50° C., it takes too much time to hydrate the green pellet. A temperature of the hydration reaction gas of over 100° C., on the other hand, gives rise to safety and economic problems.

Drying the green pellet in the drying zone by means of the drying gas blown into this zone has an object to reduce the water content in the pellet after hydration to obtain a non-sintered pellet having a high crushing strength. The temperature of the drying gas should be within the range of from 100° to 300° C. If the temperature of the drying gas is under 100° C., drying exerts only a poor effect on the improvement of crushing strength of the non-sintered pellet. If the temperature of the drying gas is over 300° C., on the other hand, crushing strength of the sintered pellet is worsened.

Use of a gas containing at least 3 vol. % carbon dioxide gas as the drying gas in the drying zone is very effective in increasing crushing strength of the non-sintered pellet. More particularly, when the green pellet is dried after hydration by means of a gas containing at least 3 vol. % carbon dioxide gas, not only the green pellet is dried, but also the hydrates containing calcium constituents in the green pellet are subjected to a carbonation reaction which produces calcium carbonate ($CaCO_3$) in the green pellet. As a result, a non-sintered pellet having the improved crushing strength can be obtained. The content of carbon dioxide gas in the drying gas should be at least 3 vol. %. A content of carbon dioxide of under 3 vol. % cannot give the effect of improving crushing strength of the non-sintered pellet through the above-mentioned carbonation reaction.

The method and the apparatus for continuously manufacturing a non-sintered pellet of the present invention are described below with reference to drawings.

FIG. 1 is a schematic drawing illustrating an embodiment of the apparatus for manufacturing a non-sintered pellet used in the method of the present invention. In FIG. 1, 1 is a shaft type reactor provided with a green pellet inlet 2 at the upper end thereof and a non-sintered pellet outlet 3 at the lower end thereof. The shaft type reactor 1 comprises a pre-treating zone A, a hydration reaction zone B following the pre-treating zone A and a drying zone C following the hydration reaction zone B and the shaft type reactor 1 is adapted to contain a green pellet continuously supplied through the green pellet inlet 2.

The pre-treating zone A is provided with a pre-treating gas blowing port 4 on a side wall 1*a* thereof, and a pre-treating gas discharge port 5 located below the pre-treating gas blowing port 4, and similarly provided with another pre-treating gas blowing port 4' on the other side wall 1*b* thereof and another pre-treating gas discharge port 5' located below the pre-treating gas blowing port 4'. The pre-treating zone A is adapted to pre-dry the green pellet in the pre-treating zone A until the difference in the water content in the green pellet before and after the pre-drying becomes at least 4 wt. % within the limits in which the green pellet in the pre-treating zone A contains at least 2 wt. % water, by means of a pre-treating gas with a relative humidity of up to 70% and at a temperature within the range of from 65° to 250° C., which is blown into the pre-treating zone A through the pre-treating gas blowing ports 4 and 4' and discharged to the outside through the pre-treating gas discharge ports 5 and 5'. The pre-treating gas blowing ports 4 and 4' may be provided on the top portion of the pre-treating zone A.

The hydration reaction zone B is provided with a plurality of hydration reaction gas blowing ports 6 and a plurality of hydration reaction gas discharge ports 7 on the opposite side walls 1*a* and 1*b* thereof. The hydration reaction gas blowing ports 6 are arranged opposite to the hydration reaction gas discharge ports 7. The hydration reaction zone B is adapted to hydrate the green pellet in the hydration reaction zone B by means of a hydration reaction gas at a temperature within the range of from 50° to 100° C. containing saturated steam, which is blown into the hydration reaction zone B through the hydration reaction gas blowing ports 6 and discharged to the outside through the hydration reaction gas discharge ports 7. In the embodiment shown in FIG. 1, the hydration reaction gas blowing ports 6 comprise three blowing ports 6*a*, 6*b* and 6*c*, and the hydration reaction gas discharge ports 7 comprise three discharge ports 7*a*, 7*b* and 7*c*; hydration reaction gases at different temperatures within the range of from 50° to 100° C. are blown respectively through the hydration reaction gas blowing ports 6*a*, 6*b* and 6*c* into the hydration reaction zone B, and are discharged to the outside through the hydration reaction gas discharge ports 7*a*, 7*b* and 7*c*.

The drying zone C is provided with a drying gas blowing port 8 and a drying gas discharge port 9 on the opposite side walls 1*a* and 1*b* thereof. The drying gas blowing port 8 is arranged opposite to the drying gas discharge port 9. The drying zone C is adapted to dry the green pellet in the drying zone C to continuously manufacture a non-sintered pellet, by means of a drying gas at a temperature within the range of from 100° to 300° C., which is blown into the drying zone C through the drying gas blowing port 8 and discharged to the outside through the drying gas discharge port 9. In FIG. 1, 10 is a conveyor for transporting the non-sintered pellet discharged from the non-sintered pellet outlet 3, provided below the lower end of the shaft type reactor 1.

The green pellet containing water of from 6 to 20 wt. %, which has been continuously supplied into the shaft type reactor 1 through the green pellet inlet 2 at the upper end thereof, is pre-dried in the pre-treating zone A until the difference in the water content in the green pellet before and after the pre-drying becomes at least 4 wt. % within the limits in which the green pellet in the pre-treating zone A contains at least 2 wt. % water, by means of a pre-treating gas with a relative humidity of up to 70% and at a temperature within the range of from 65° to 250° C., which is blown into the pre-treating zone A through the pre-treating gas blowing ports 4 and 4'. Then, the green pellet pre-dried as mentioned above is hydrated in the hydration reaction zone B by means of a hydration reaction gas at a temperature within the range of from 50° to 100° C. containing saturated steam, which is blown into the hydration reaction zone B through the hydration gas blowing ports 6. When the temperature of the hydration reaction gas lowers through heat exchange with the green pellet, at least part of steam contained in the hydration reaction gas condenses to generate condensation heat, thus making up for the heat of the gas lost through the heat exchange with the green pellet. Thus, the green pellet in the hydration reaction zone B is effectively heated and hydrated by the hydration reaction gas. The hydration reaction gas may be heated to above the above-mentioned prescribed temperature, and then sent into a conduit, because the hydration reaction gas may be cooled in the conduit before reaching the hydration reaction zone B.

As shown by the solid arrow in FIG. 1, the hydration reaction gas is blown into the hydration reaction zone B through the hydration reaction gas blowing ports 6 provided on the side wall 1*a* of the hydration reaction zone B, and discharged to the outside through the hydration reaction gas discharge ports 7 provided on the other side wall 1*b*. The flow of the hydration reaction gas may be switched over at prescribed time intervals to blow the hydration reaction gas into the hydration reaction zone B through the hydration reaction gas discharge ports 7 provided on the other side wall 1*b* and discharge the gas to the outside through the hydration reaction gas blowing ports 6 provided on the side wall 1*a*. This permits more uniform heating of the green pellet in the hydration reaction zone B.

The green pellet hydrated in the hydration reaction zone B is dried in the drying zone C by means of a drying gas at a temperature within the range of from 100° to 300° C. which is blown into the drying zone C through the drying gas blowing port 8 to harden into a non-sintered pellet which is then continuously discharged through the non-sintered pellet outlet 3.

Figure 2:
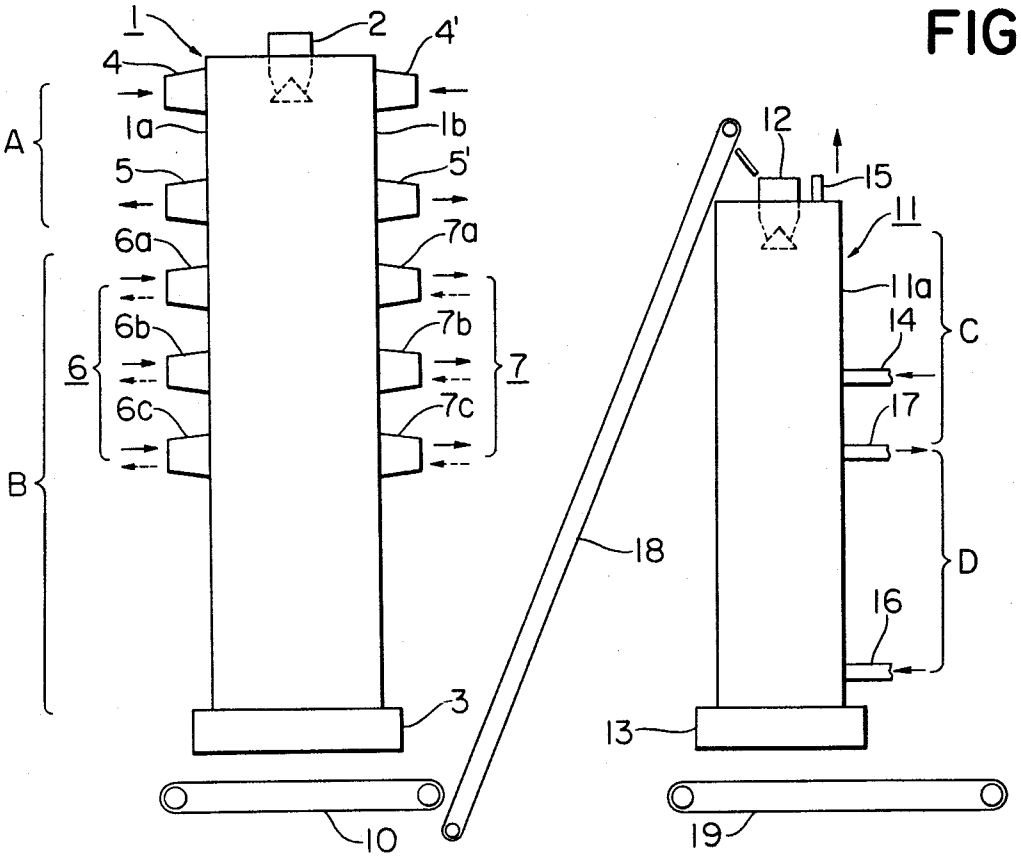

FIG. 2 is a schematic drawing illustrating another embodiment of the apparatus for manufacturing a non-sintered pellet used in the method of the present invention. In the apparatus shown in FIG. 2, the drying zone C comprises a separate shaft type reactor 11. The separate shaft type reactor 11 is provided at the upper end thereof with an inlet 12 for the green pellet continuously supplied from the hydration reaction zone B, and at the lower end thereof with an outlet 13 for the non-sintered pellet. The separate shaft type reactor 11 includes a cooling zone D following the drying zone C.

The drying zone C is provided at the lower portion of a sidewall 11*a* thereof with at least one drying gas blowing port 14, and at the upper end of the sidewall 11*a* thereof with at least one drying gas discharge port 15. The cooling zone D is provided at the lower portion of the sidewall 11*a* thereof with at least one cooling gas blowing port 16, and at the upper portion of the sidewall 11*a* thereof with at least one cooling gas discharge port 17. The cooling zone D is adapted to cool the non-sintered pellet introduced into the cooling zone D from the drying zone C by means of a cooling gas which is blown into the cooling zone D through the cooling gas blowing port 16 and discharged to the outside through the cooling gas discharge port 17. In FIG. 2, 18 is a conveyor for transporting the non-sintered pellet after hydration discharged through the non-sintered pellet outlet 3 of the shaft type reactor 1 to the inlet 12 of the separate shaft type reactor 11, and 19 is a conveyor for transporting the non-sintered pellet discharged through the outlet 13 of the separate shaft type reactor 11.

The green pellet containing water of from 6 to 20 wt. %, which has been continuously supplied into the shaft type reactor 1 through the green pellet inlet 2 at the upper end thereof, is pre-dried in the pre-treating zone A, then hydrated in the hydration reaction zone B as in the first embodiment explained with reference to FIG. 1, and then discharged through the outlet 3. The green pellet discharged through the outlet 3 from the hydration reaction zone B is transported on the conveyors 10 and 18, continuously supplied into the separated shaft type reactor 11 through the inlet 12 at the upper end thereof, and dried in the drying zone C into a non-sintered pellet. The non-sintered pellet is cooled in the cooling zone D following the drying zone C, discharged through the outlet 13, and transported on the conveyor 19. The cooling gas having cooled the non-sintered pellet, which is discharged through the cooling gas discharge port 17 from the cooling zone D may be directed to the pre-treating gas blowing port 4 of the shaft type reactor 1 and blown into the pre-treating zone A as the pre-treating gas.

In the above-mentioned apparatus, the separate shaft type reactor 11 may comprise only the drying zone C without providing a cooling zone D. In this case, the non-sintered pellet dried in the drying zone C is discharged through the outlet 13, and is allowed to cool in the open air while being transported on the conveyor 19.

Since the green pellet continuously supplied into the shaft type reactor 1 through the green pellet inlet 2 at the upper end thereof is pre-dried in the pre-treating zone A until the difference in the water content in the green pellet before and after the pre-drying becomes at least 4 wt. % within the limits in which the green pellet in the pre-treating zone A contains at least 2 wt. % water, as described above, the green pellet never disintegrates while being hydrated in the hydration reaction zone B. Therefore, scaffolding or abnormal transfer of the green pellet never takes place in the shaft type reactor 1, thus permitting continuous manufacture of a high-strength and high-quality non-sintered pellet at a high yield.

It is necessary to determine the rate of discharge of the non-sintered pellet from the shaft type reactor 1 and the separate shaft type reactor 11 so that the green pellet supplied into the shaft type reactor 1 and the separate shaft type reactor 11 through the inlets 2 and 12 at the upper ends thereof is transferred at an appropriate speed through the shaft type reactor 1 and the separate shaft type reactor 11. If the above-mentioned transfer of the green pellet is too fast, the pre-drying, the hydration and the drying of the green pellet in the shaft type reactor 1 and the separate shaft type reactor 11 become insufficient and a high-strength non-sintered pellet cannot be manufactured.

Formation of the side walls of the shaft type reactor 1 and the separate shaft type reactor 11 with an angle of inclination of from about 0.5 to 2 relative to the vertical axis so as to downwardly and outwardly flare is effective in ensuring smooth transfer of the green pellet and the non-sintered pellet in the shaft type reactor 1 and the separate shaft type reactor 11.

Now, the present invention is described in detail be means of examples.

EXAMPLE 1

A green pellet having an average water content of 6.9 wt. % and a particle diameter of from 10 to 16 mm was prepared by adding 10 wt. % Portland cement as the hydraulic binder and a prescribed amount of water to 90 wt. % iron ore fine as theraw material, mixing same, and forming the resultant mixture. The green pellet thus prepared was supplied into the apparatus as shown in FIG. 2 to subject the green pellet sequentially to pre-drying, hydration, drying and cooling under the followed conditions:

(1)Quantity of green pellet supplied: 270 kg/hr
(2) Pre-treating gas: air at 130° C.
(3) Amount of pre-treating gas blown: 260 $Nm^3$/hr
(4) Temperature of green pellet after pre-treatment: about 40° C.
(5) Water content in green pellet after pre-drying: 2.3 wt. % on the average
(6) Hydration reaction gas: air at 70° C. containing saturated steam, and steam at 100° C.
(7) Amount of hydration reaction gas blown: 45 kg/hr
(8) Temperature of green pellet after hydration: about 100° C.
(9) Drying gas: air at 210° C.
(10) Amount of drying gas blown: 400 $Nm^3$/hr
(11) Temperature of non-sintered pellet after drying: about 200° C.
(12) Cooling gas: air at room temperature
(13) Amount of cooling gas blown: 200 $Nm^3$/hr
(14) Staying period of green pellet in shaft type reactors:
Shaft type reactor: 9 hours
Separate shaft type reactor: 1.5 hours
(15) Transfer pattern of green pellet in shaft type reactors:
Discharge cycle from shaft type reactor: every 6 minutes
Transfer distance through shaft type reactor: about 30 mm per cycle.

As a result of the above-mentioned treatment, while the green pellet after hydration reaction had a crushing strength of 80 kg per piece of pellet on the average, the non-sintered pellet after drying in the drying zone showed a crushing strength of 160 kg per piece of pellet on the average; thus proving the possibility of manufacturing a high-strength and high-quality non-sintered pellet at a high yield. During operation, disintegration of the green pellet moving through the shaft type reactor never occurred, and consequently, no scaffolding nor abnormal transfer of the green pellet was caused by mutual adherence of pieces of the green pellet into clusters in the shaft type reactor, thus permitting stable and continuous operation for a long period of time.

Among the above-mentioned conditions, a gas containing 20 vol. % carbon dioxide gas was employed in place of the air. This improved the crushing strength of the non-sintered pellet after drying to 180 kg per piece of pellet on the average, and permitted manufacture of a high-strength and high-quality non-sintered pellet than in the case with the air.

EXAMPLE 2

A green pellet having an average water content of 7.7 wt. % and a particle diameter of from 10 to 16 mm was prepared by adding 14 wt. % crushed granulated blast furnace slag, 0.9 wt. % calcium hydroxide and 0.1 wt. % gypsum as the hydraulic binder and a prescribed amount of water to raw materials comprising 32.8 wt. % iron ore fine, 26.4 wt. % iron sand and 25.8 wt. % dust mainly containing iron oxides, mixing same, and forming the resultant mixture. The green pellet thus prepared was supplied into the apparatus as shown in FIG. 2 to subject the green pellet sequentially to pre-drying, hydration, drying and cooling under the following conditions:

(1) Quantity of green pellet supplied: 300 kg/hr
(2) Pre-treating gas: air at 130° C.
(3) Amount of pre-treating gas blown: 450 $Nm^3$/hr
(4) Temperature of green pellet after pre-treatment: about 40° C.
(5) Water content in green pellet after pre-drying: 2.3 wt. % on the average
(6) Hydration reaction gas: air at 70° C. and 90° C. containing saturated steam, and steam at 100° C.
(7) Amount of hydration reaction gas blown: 45 kg/hr
(8) Temperature of pellet after hydration: about 100° C.
(9) Drying gas: air at 210° C.
(10) Amount of drying gas blown: 450 $Nm^3$/hr
(11) Temperature of non-sintered pellet after drying: about 200° C.
(12) Cooling gas: air at room temperature
(13) Amount of cooling gas blown: 200 $Nm^3$/hr
(14) Staying period of green pellet in shaft type reactors:
Shaft type reactor: 8 hours
Separate shaft type reactor: 1.5 hours
(15) Transfer pattern of green pellet in shaft type reactors:
Discharge cycle from shaft type reactor: every 6 minutes
Transfer distance through shaft type reactor: about 30 mm per cycle.

As a result of the above-mentioned treatment, while the green pellet after hydration reaction had a crushing strength of 85 kg per piece of pellet on the average, the non-sintered pellet after drying in the drying zone showed a crushing strength of 160 kg per piece of pellet on the average; thus proving the possibility of manufacturing a high-strength and high-quality non-sintered pellet at a high yield. During operation, as in Example 1, disintegration of the green pellet moving through the shaft type reactor never occured, and consequently, no scaffolding nor abnormal transfer of the green pellet was caused by mutual adherence of pieces of the green pellet into clusters in the shaft type reactor, thus permitting stable and continuous operation for a long period of time.

According to the method and the apparatus for manufacturing a non-sintered pellet of the present invention, as described above in detail, it is possible to continuously manufacture a high-strength and high-quality non-sintered pellet at a high yield in a short period of time without causing disintegration of the green pellet in the shaft type reactor, thus providing many industrially useful effects.

What is claimed is:

1. A method for continuously manufacturing a non-sintered pellet, which comprises:

adding a hydraulic binder and water to raw materials which comprise at least one of an iron ore fine, a non-ferrous ore fine and a dust mainly containing oxides of iron or non-ferrous metal, and mixing same; forming the resultant mixture to prepare a green pellet having a water content within the range of from 6 to 20 wt. %; continuously supplying said green pellet into a shaft type reactor which comprises a pre-treating zone, a hydration reaction zone following said pre-treating zone and a drying zone following said hydration reaction zone, to continuously pass said green pellet sequentially through said pre-treating zone, said hydration reaction zone and said drying zone; blowing a pre-treating gas at a prescribed temperature into said pre-treating zone to pre-treat said green pellet in said zone; blowing a gas for hydration reaction at a temperature within the range of from 50 to 100° C. containing saturated steam into said hydration reaction zone to hydrate said green pellet in said zone; and, blowing a drying gas at a temperature within the range of from 100° to 300° C. into said drying zone to dry said green pellet in said zone, thereby hardening said green pellet in said drying zone to continuously manufacturing a non-sintered pellet;

characterized by:

blowing said pre-treating gas with a relative humidity of up to 70% and at a temperature within the range of from 65° to 250° C. into said pre-treating zone to pre-dry said green pellet in said pre-treating zone until the difference in the water content in said green pellet before and after said pre-drying becomes at least 4 wt. % within the limits in which said green pellet in said pre-treating zone contains at least 2 wt. % water.

2. The method as claimed in claim 1, wherein:

a gas containing at least 3 vol. % carbon dioxide gas is used as said drying gas blown into said drying zone.

3. The method as claimed in claim 1 wherein said raw materials comprise at least one of an iron ore fine and a dust mainly containing oxides of iron.

4. The method as claimed in claim 2 wherein said raw materials comprise at least one of an iron ore fine and a dust mainly containing oxides of iron.

* * * * *